US007308778B2

(12) United States Patent
Nanayakkara

(10) Patent No.: US 7,308,778 B2
(45) Date of Patent: Dec. 18, 2007

(54) METAL STUD FRAME

(76) Inventor: Lakdas Nanayakkara, 2211 NE. 54th St., Fort Lauderdale, FL (US) 33308

( * ) Notice: Subject to any disclaimer, the term of this patent is extended or adjusted under 35 U.S.C. 154(b) by 631 days.

(21) Appl. No.: 10/653,112

(22) Filed: Sep. 3, 2003

(65) Prior Publication Data

US 2004/0045252 A1 Mar. 11, 2004

Related U.S. Application Data

(63) Continuation-in-part of application No. 09/480,133, filed on Jan. 10, 2000, now Pat. No. 6,615,563.

(51) Int. Cl.

| | |
|---|---|
| ***E04C 2/34*** | (2006.01) |
| ***E04C 1/00*** | (2006.01) |
| ***E04B 1/18*** | (2006.01) |
| ***E04B 2/00*** | (2006.01) |

(52) U.S. Cl. ..... 52/481.1; 52/414; 52/428; 52/431; 52/309.12

(58) Field of Classification Search ..... 52/733.2, 52/731.1, 354, 731.5, 656.1, 290, 357–364, 52/720.1, 414, 481.1, 481.2, 309.9, 309.11, 52/309.12, 426, 428, 431, 565

See application file for complete search history.

(56) References Cited

U.S. PATENT DOCUMENTS 867,251 A * 10/1907 Davis ..... 52/354
1,130,722 A * 3/1915 Fletcher ..... 52/355
2,105,771 A 1/1938 Holdsworth
4,885,884 A 12/1989 Schilger
5,081,813 A * 1/1992 White ..... 52/656.1
5,157,883 A 10/1992 Meyer
5,315,804 A 5/1994 Attalla
5,325,651 A * 7/1994 Meyer et al. ..... 52/715
5,555,698 A * 9/1996 Mandish ..... 52/745.17
5,611,183 A * 3/1997 Kim ..... 52/426
5,664,378 A * 9/1997 Bettigole et al. ..... 52/414
5,765,331 A * 6/1998 Chang ..... 52/348
6,708,459 B2 * 3/2004 Bodnar ..... 52/356
7,028,439 B2 * 4/2006 Foderberg et al. ..... 52/414
7,197,854 B2 * 4/2007 Bettigole et al. ..... 52/414

* cited by examiner

*Primary Examiner*—Robert Canfield
*Assistant Examiner*—Hunter M Dreidame
(74) *Attorney, Agent, or Firm*—Melvin K. Silverman; Yi Li

(57) ABSTRACT

A metallic stud for use in the framing of structures, the stud definable in terms of an x, y, z coordinate system, in which the z-axis corresponds to the gravity vector. The metallic stud includes a z-axis elongate generally rectangular integral xz plane web having a width (thickness) in a yz plane. The stud also includes a series of xz plane tabs each having a parallelogram-like geometry and an outer major base. The series of xz plane tabs project within at least one of a positive or negative x-axis direction, in which the tabs interdigitate with void spaces along at least one z-axis edge of the web. The metallic stud also includes a z-axis elongate apex element, within xz plane web, projecting in a y-axis plane and integrally dependent from the web of the stud.

4 Claims, 11 Drawing Sheets

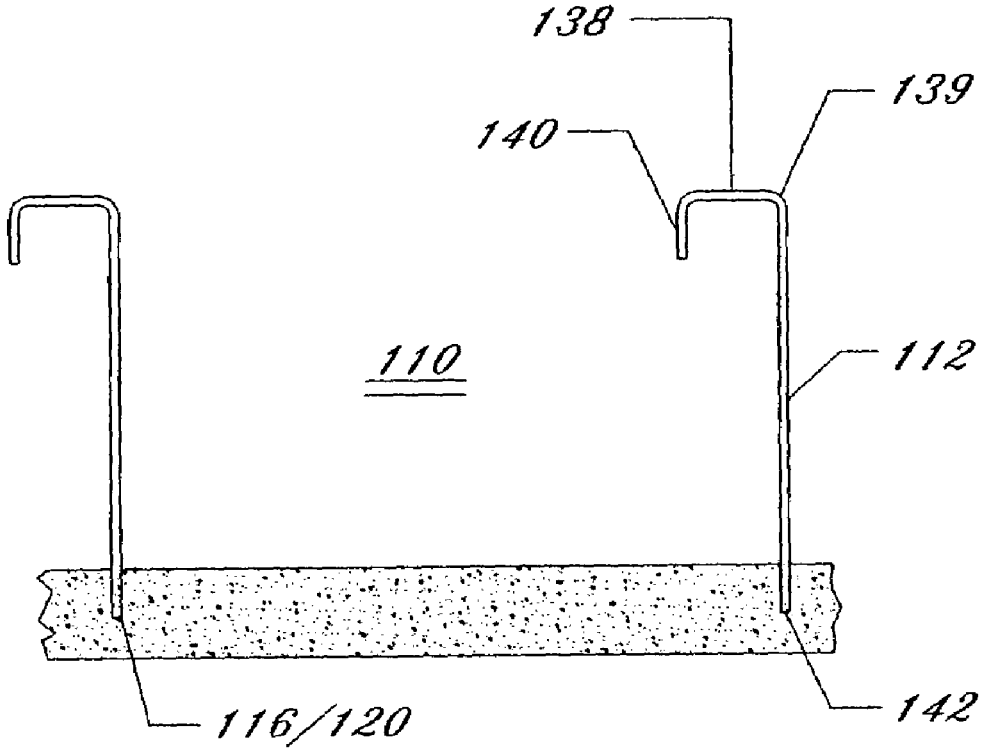
FIG. 6
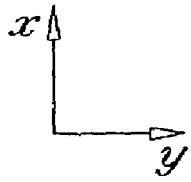

METAL STUD FRAME

REFERENCE TO RELATED APPLICATION

This case is a continuation-in-part of application Ser. No. 09/480,133, filed Jan. 10, 2000, now U.S. Pat. No. 6,615,563 entitled Metal Stud Frame Element, which application is pending.

BACKGROUND OF THE INVENTION

The present invention relates to metallic stud frames of a type used in the formation of a frame of a residential or commercial structure.

Historically, frames of such structures were formed of either wood, steel or concrete. In the case of load bearing structures, it is common to use a steel bar, know as rebars within a poured concrete structure. The use of vertical light gauge steel studs, in lieu of wooden studs to accomplish internal framing within a wood frame structure, is also well known in the art.

The prior art is also reflected in such references as U.S. Pat. No. 2,105,771 (1938) to Holdsworth, entitled Wall Construction; U.S. Pat. No. 4,885,884 (1989) to Schilger, entitled Building Panel Assembly; U.S. Pat. No. 5,157,883 (1992) to Meyer, entitled Metal Frames; and U.S. Pat. No. 5,315,804 (1994) to Attalla, entitled Metal Framing Member.

It is, however, not known to employ thin gauge vertical studs in combination with exterior wall concrete framing in which the vertical stud operates to define an offset or distance between an exterior poured concrete wall and an interior plasterboard wall which is secured to one surface of such a vertical steel stud. A need for such a vertical steel stud frame element has arisen as a consequence of rapid on-site assembly high techniques employing thin external concrete walls which have developed in the construction arts. The present invention therefore relates to such vertical metallic stud in which one or both rectilinear edges thereof may be poured as a part of a process of casting of an exterior concrete wall, its base and/or load bearing elements of the resultant structure.

SUMMARY OF THE INVENTION

The instant invention relates to a metallic stud for use in the framing of structures, the stud definable in terms of an x, y, z coordinate system, in which the z-axis corresponds to the gravity vector. Therein, the metallic stud comprises a z-axis elongate generally rectangular integral xz plane web having a width (thickness) in a yz plane thereof. The stud further includes a series of xz plane tabs each having a parallelogram-like geometry and an outer major base thereof. Said series of xz plane tabs project within at least one of a positive or negative x-axis direction, in which said tabs interdigitate with void spaces along at least one z-axis edge of said web. Said stud further includes a z-axis elongate apex element projecting in a y-axis plane and integrally dependent from said web of said stud.

It is accordingly an object of the present invention to provide a metallic stud framing element particularly adapted for use within a concrete framing structure.

It is another object to provide a metallic stud of the above type which can function as an interior to exterior wall defining offset.

It is a further object of the invention to provide a vertical metallic stud capable of defining the shape and extent of vertical load bearing concrete columns within a poured concrete structure.

The above and yet other objects and advantages of the present invention will become apparent from the hereinafter set forth Brief Description of the Drawings, Detailed Description of the Invention and claim appended herewith.

BRIEF DESCRIPTION OF THE DRAWINGS

FIG. 6 is a cross-sectional view, in the xy plane showing the incorporation of one z-axis side of the embodiment of the metallic stud of FIG. 4 into a vertical concrete panel.

DETAILED DESCRIPTION OF THE INVENTION

Figure 1:
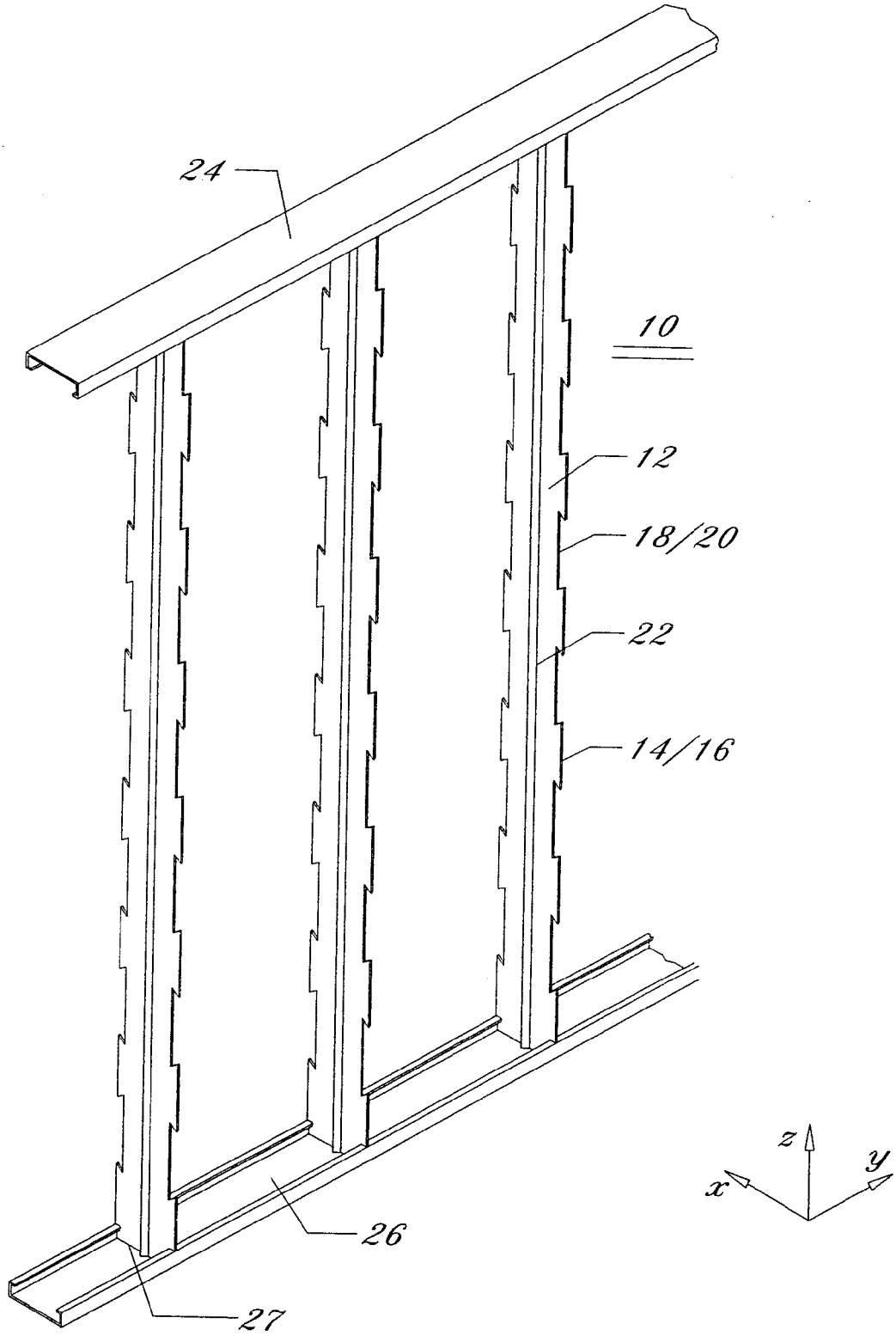
FIG. 1 is a perspective view of a first embodiment of the inventive metallic stud secured within upper and lower U-shaped conventional metallic studs.

With reference to the perspective view of FIG. 1, the present inventive metallic stud for use in the framing of structures may be seen to be definable with reference to an x, y, z coordinate system which is shown as a part of FIG. 1. More particularly, an inventive stud 10 may be seen to include an integral web 12 (see also FIG. 2) having a z-axis elongate structure which is substantially rectangular. As may be noted in FIG. 1, the width or thickness of said web is in the yz plane thereof.

Metallic stud 10 is, more particularly, characterized by a series of xz plane tabs 14 having a parallelogram-like geometry and a major base 16 which projects in either or both a positive and negative x-axis direction. As may be further noted, said tabs 16 interdigitate with complementally shaped void spaces 18, that is, major base 20 of void space 18 interdigitates with major base 16 of each tab 14 and projects in an opposite x-axis direction therefrom. In a preferred embodiment, the z-axis length of major base 16 of tabs 14 is equal to major space 20 of each void space 18. However, many variations of this ratio are within the scope of the present invention.

Figure 2:
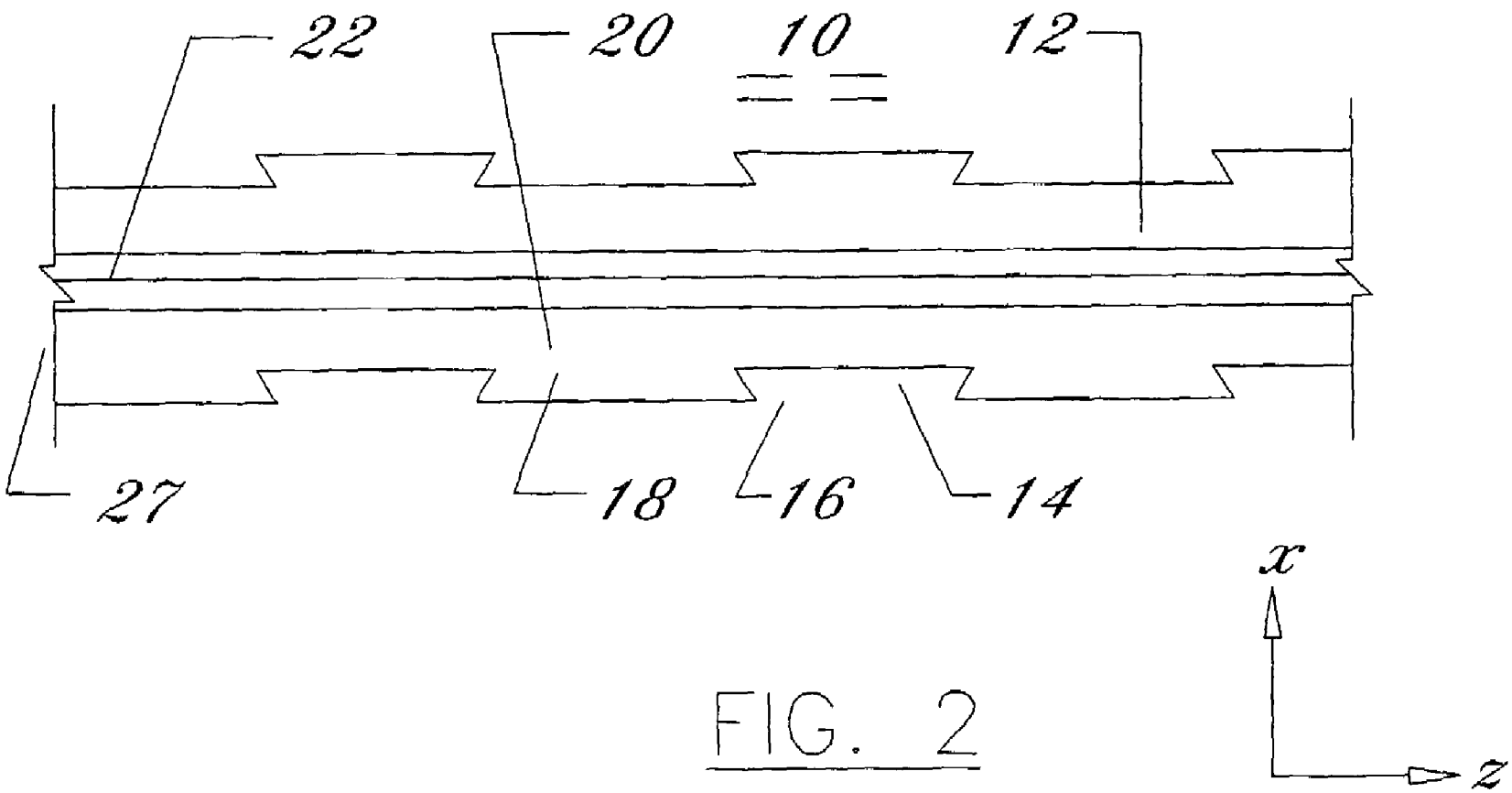
FIG. 2 is an xz plane view of web of the inventive metallic stud of FIG. 1.
Figure 3:
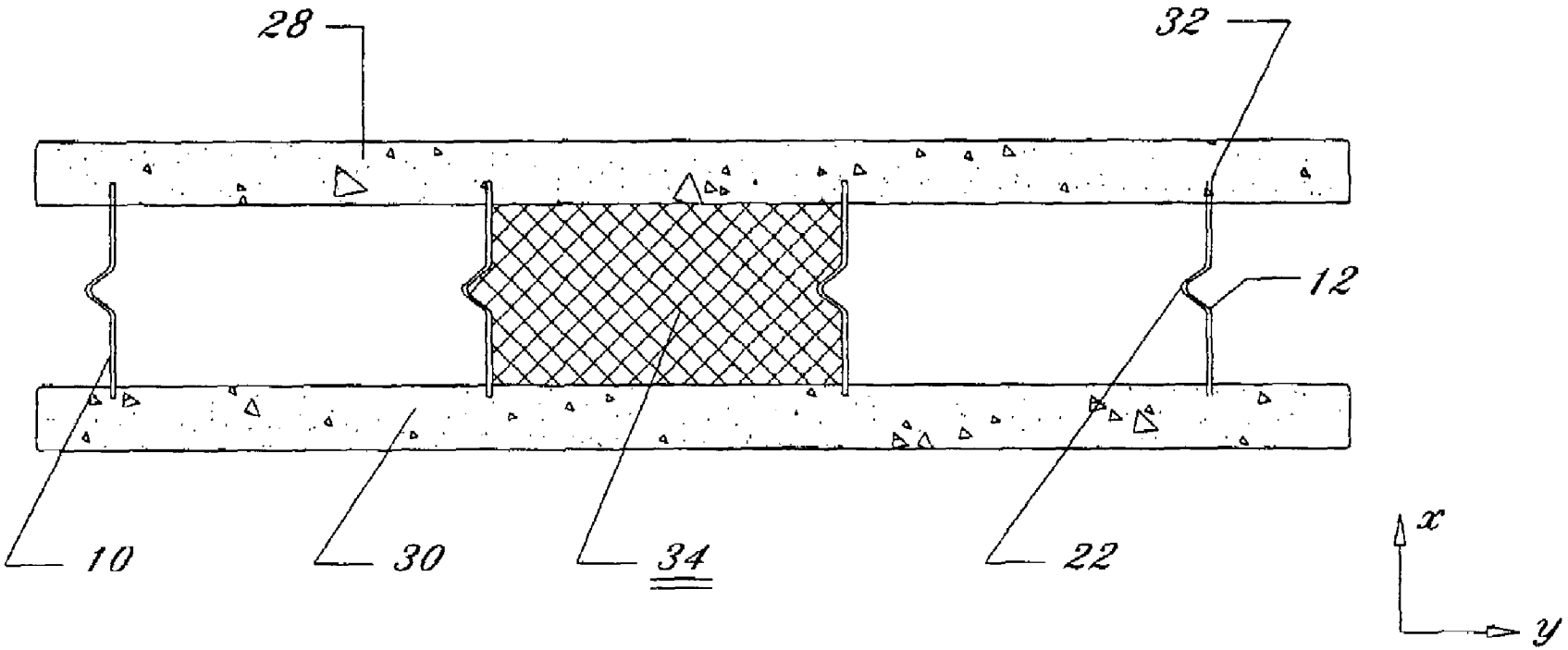
FIG. 3 is a xy plane cross-sectional view of the inventive metallic stud when incorporated into vertical concrete panels into which z-axis edges of the stud are embedded.

With further reference to FIGS. 1 and 2, the inventive metallic stud may be seen to also include a z-axis elongate apex element 22 which projects in a y-axis plane from said web 12 and is integrally dependent therefrom. As may be noted in FIG. 1, studs 10, when assembled into a larger system, are first vertically positioned within conventional U-shaped metallic studs 24 and 26. Thereafter, as is shown in FIG. 3, vertical concrete panels are poured about the x-axis ends 27 of each web 12, thereby vertically securing each metallic stud within said vertical concrete panels 28 and 30. Where thermal, audio or vibrational insulation is required, an appropriate foam 34 may be employed to fill the space between respective studs 10.

Figure 4:
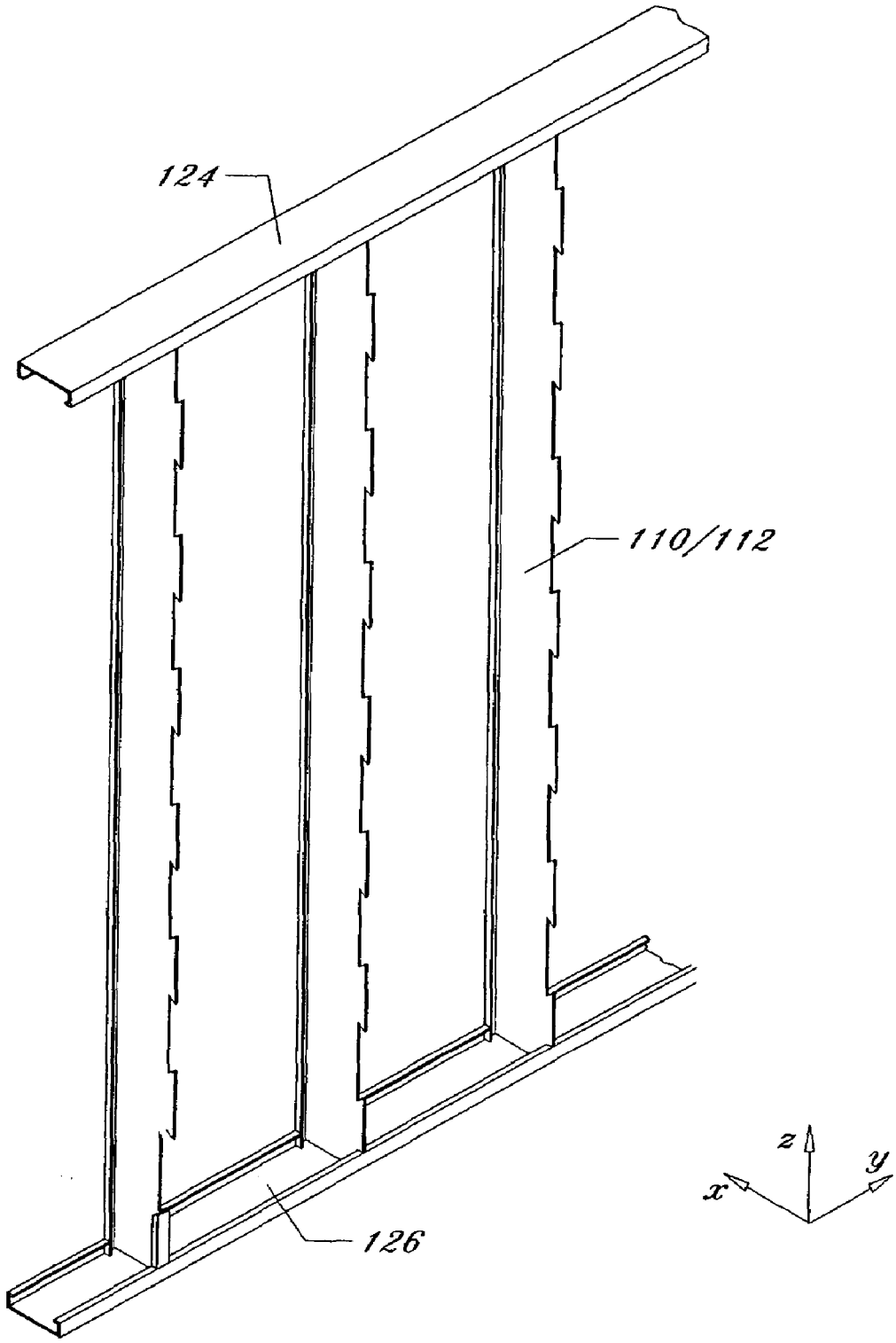
FIG. 4 is a perspective view of a second embodiment of the invention secured within conventional upper and lower U-shaped metallic studs.
Figure 5:
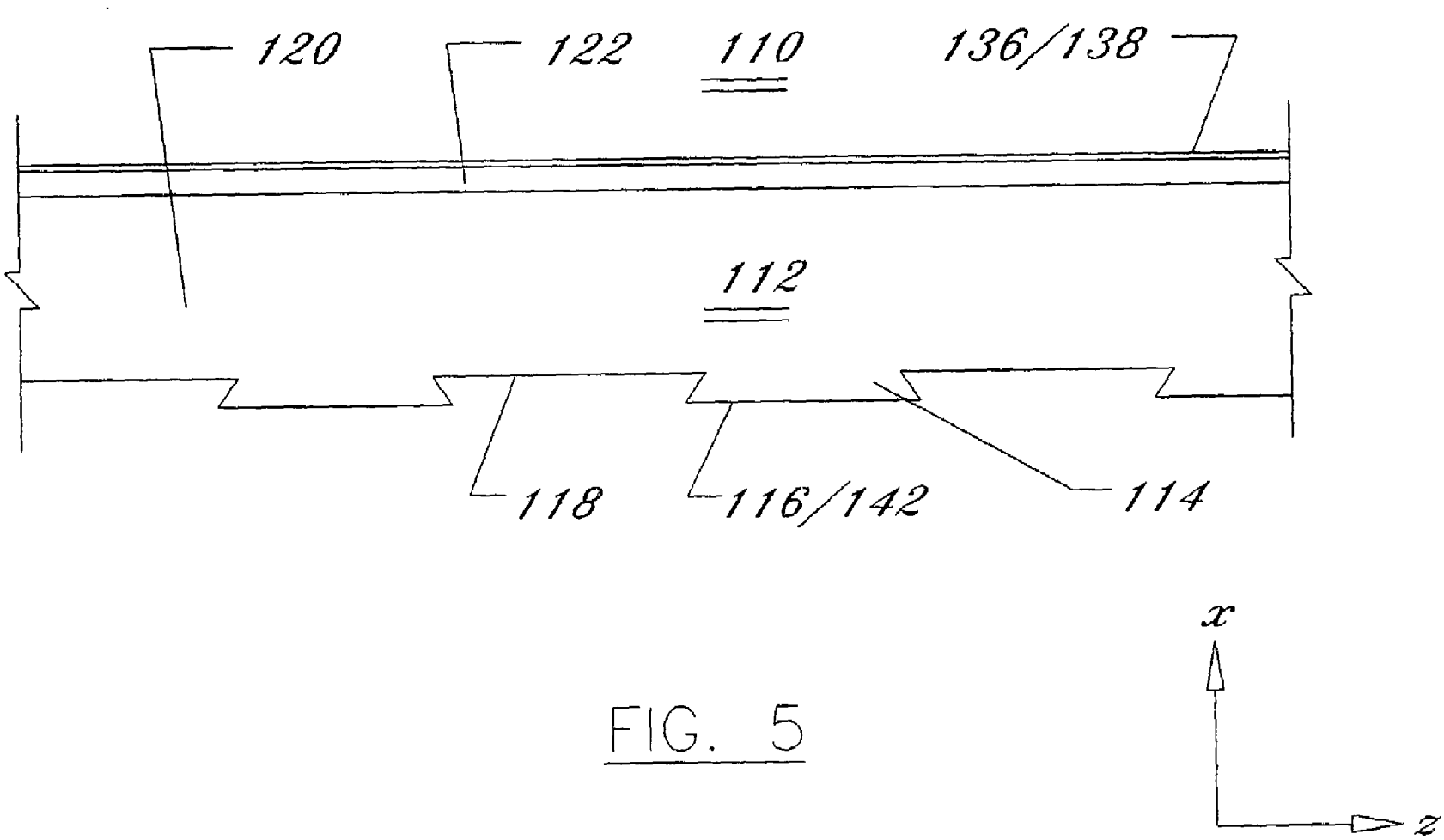
FIG. 5 is an xz plane view of the embodiment of the metallic stud of FIG. 4.

In FIGS. 4-5 is shown a further embodiment of the invention, namely, a metallic stud 110 which, as may be noted in FIGS. 4 and 5, closely resembles the geometry of one z-axis side of the embodiment of FIGS. 1-3. Therein, the lower z-axis edge of metallic stud 110 includes alternating parallelogram-like tabs 114, each having a major base 116 projecting in a negative x-axis direction. Therebetween are void spaces 118, each having a major base 120, in which the geometry of each void space is complemental to the geometry of each tab 116. However, in the embodiment of FIGS. 4 and 5, upper z-axis edge 136 may be provided either with a z-axis elongate apex element 122 corresponding to apex element 22 in the embodiment of FIGS. 1-3 or, alternatively, may be provided with an L-shaped element 138 (see FIG. 6). Said xy plane L-shaped element integrally depends from upper z-axis edge 139 of web 112 and, in a preferred embodiment, includes a sub-element 140 (see FIG. 6) to provide improved support for any type of paneling or sheet-like material that may be adhered to said L-shaped element 138 of metallic stud 110. Further shown in FIG. 6 is the securement of lower z-axis edge 142 within a concrete panel 130 similar to the above-described vertical concrete panels 28 and 30. Accordingly, the embodiment of FIGS. 4-6 is used where one side of the inventive metallic stud frame is to secure to an outer wall such as one formed by concrete panel 130 and in which an opposite side of the metallic stud is to support for an interior wall of a structure to be formed.

It is further noted that an x-axis dimension of said web to a z-axis dimension of each major base of said tabs defines a ratio in a range of about 1:1 to about 1:5.

Figure 7:
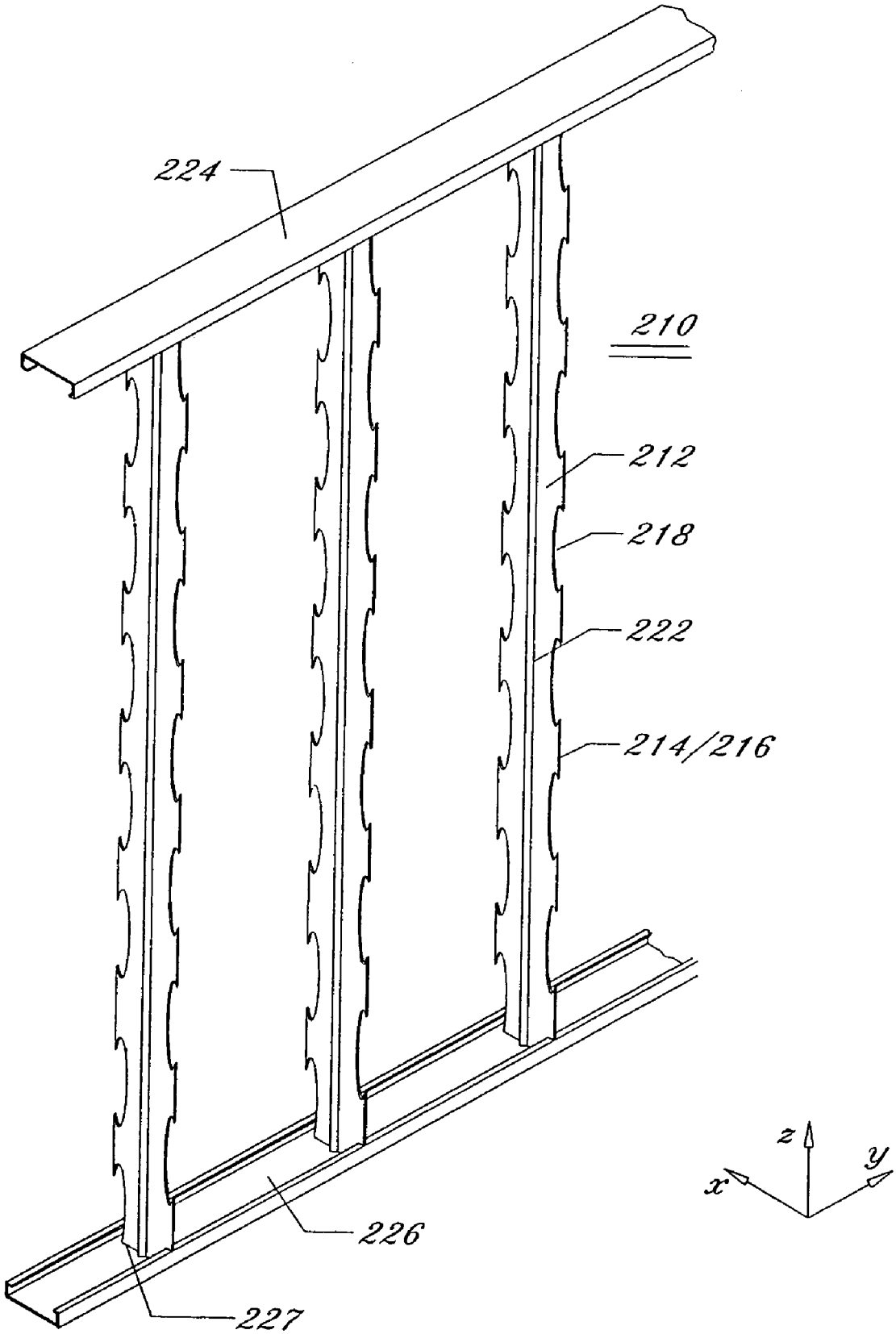
FIG. 7 is a perspective view of a third embodiment of the invention.
Figure 8:
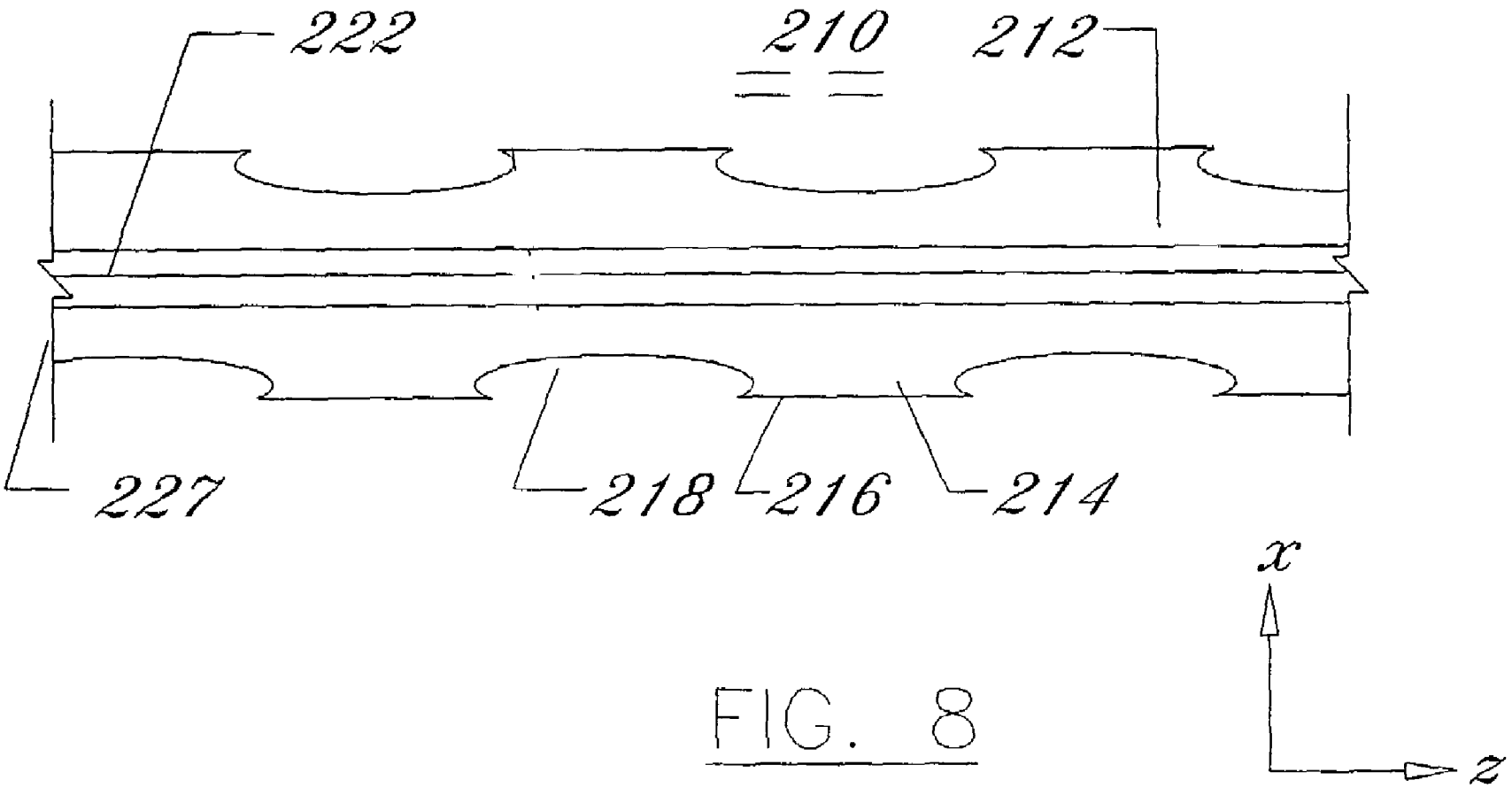
FIG. 8 is an xz plane view of the stud of FIG. 7.

With reference to FIGS. 7-8, there is shown a further embodiment of the invention comprising a metallic stud 210 positioned between upper and lower conventional U-shaped metallic studs 224 and 226, and secured at lines 227. Each metallic stud 210 is z-axis elongate and exhibits a generally rectangular integral xz plane web 212 having a thickness in a yz plane thereof. Said stud 210 is characterized by a series of xz plane tabs 214 each having an outer major base including a linear z-axis edge 216. Said tabs 214 projects within one of a positive or negative x-axis direction. In the embodiment of FIGS. 7 and 8, said tabs project in both z-axis directions, while in the embodiment of FIGS. 9-10 (more fully described below), said tabs project in one x-axis direction. Between said tabs 214 are provided catenary-like void spaces 218 which interdigitate with said tabs 214 along at least one z-axis edge of web 212.

Provided within said integral xz plane web 212 is a z-axis elongate apex element 222 projecting in a y-axis plane and integrally dependent from said web of said stud 210. As may be noted in FIGS. 7 and 8, said z-axis apex element 222 preferably projects from the web along an x-axis centerline thereof.

Figure 9:
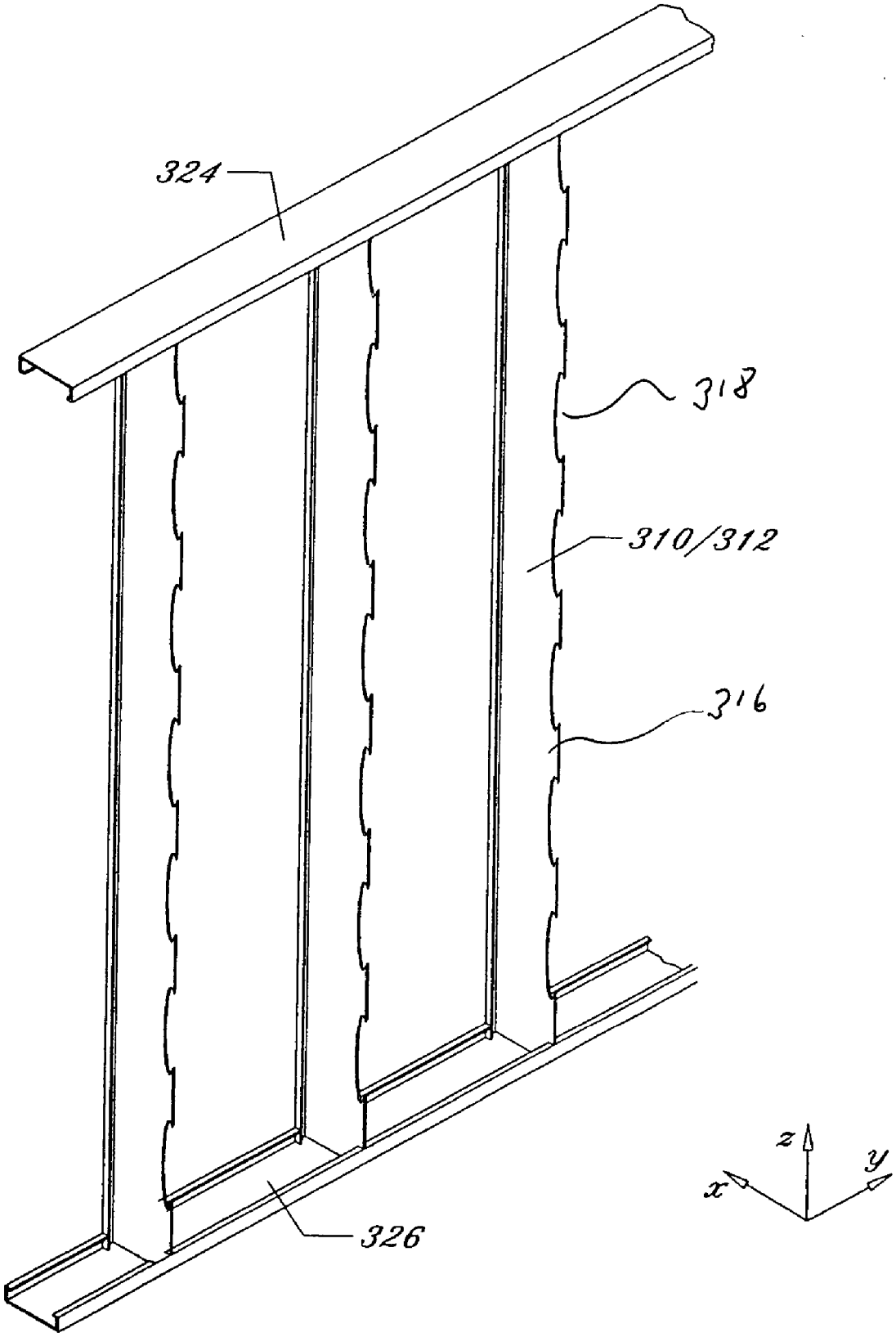
FIG. 9 is a perspective view of a fourth embodiment of the invention secured within conventional upper and lower U-shaped metallic stud.
Figure 10:
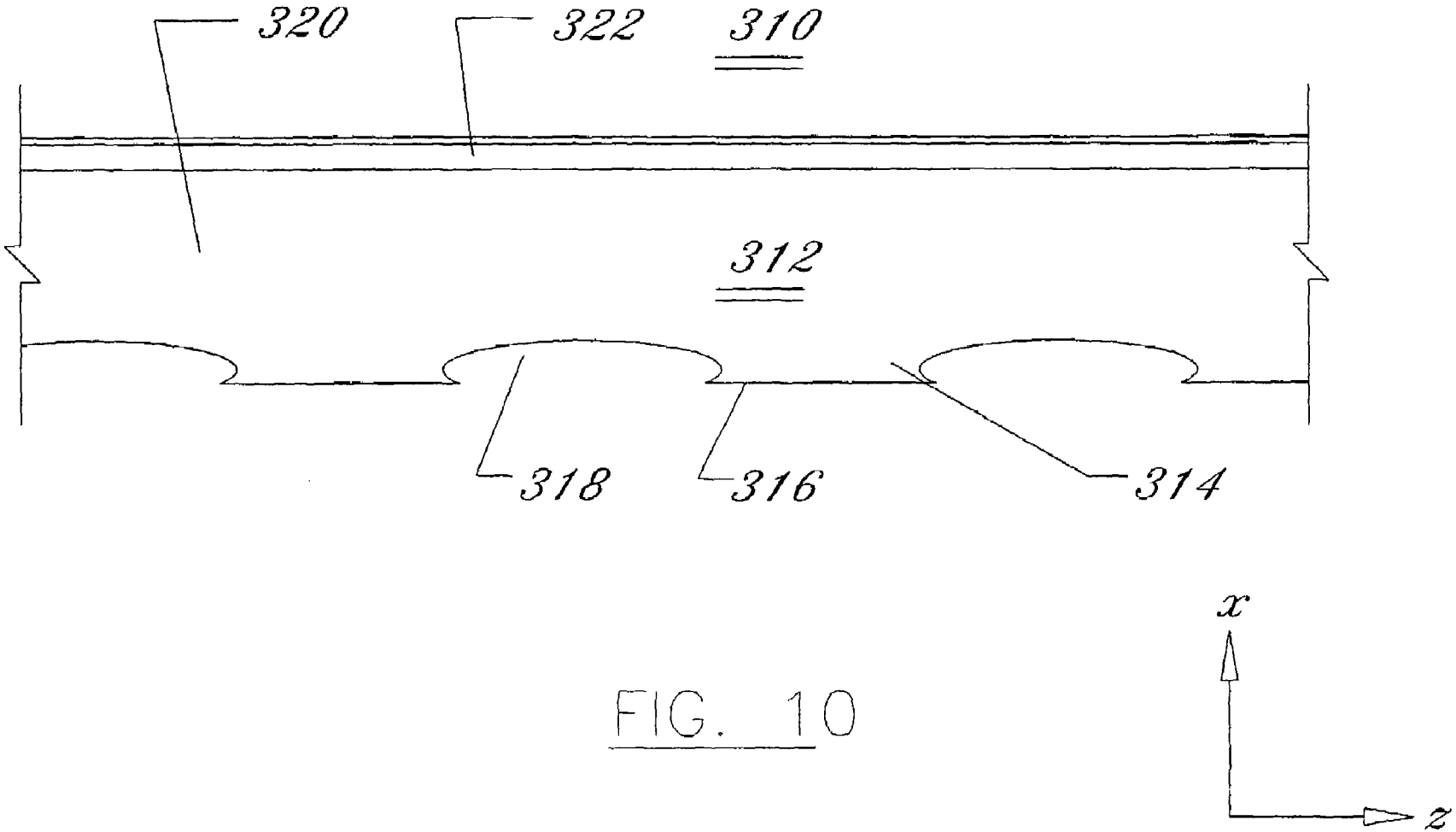
FIG. 10 is an xz plane view of the stud of FIG. 9.

Shown in FIGS. 9-10 is a stud 310 which is a further embodiment of said stud 210 in which tabs 316 project only in a negative x-axis direction from xz plane web 312 of said stud 310 which is positioned between upper and lower U-shaped framing elements 324 and 326. Further, as may be noted in FIG. 10, metallic stud 310 is provided with a z-axis elongate element 322 which projects into a y-axis plane and is integrally dependent from said web 312 of stud 310. However, unlike the embodiment of FIGS. 7-8, z-axis elongate apex element 322 is positioned along a z-axis edge of web 312 opposite to that of projecting tabs 314 and catenary-like void spaces 318.

Figure 11:
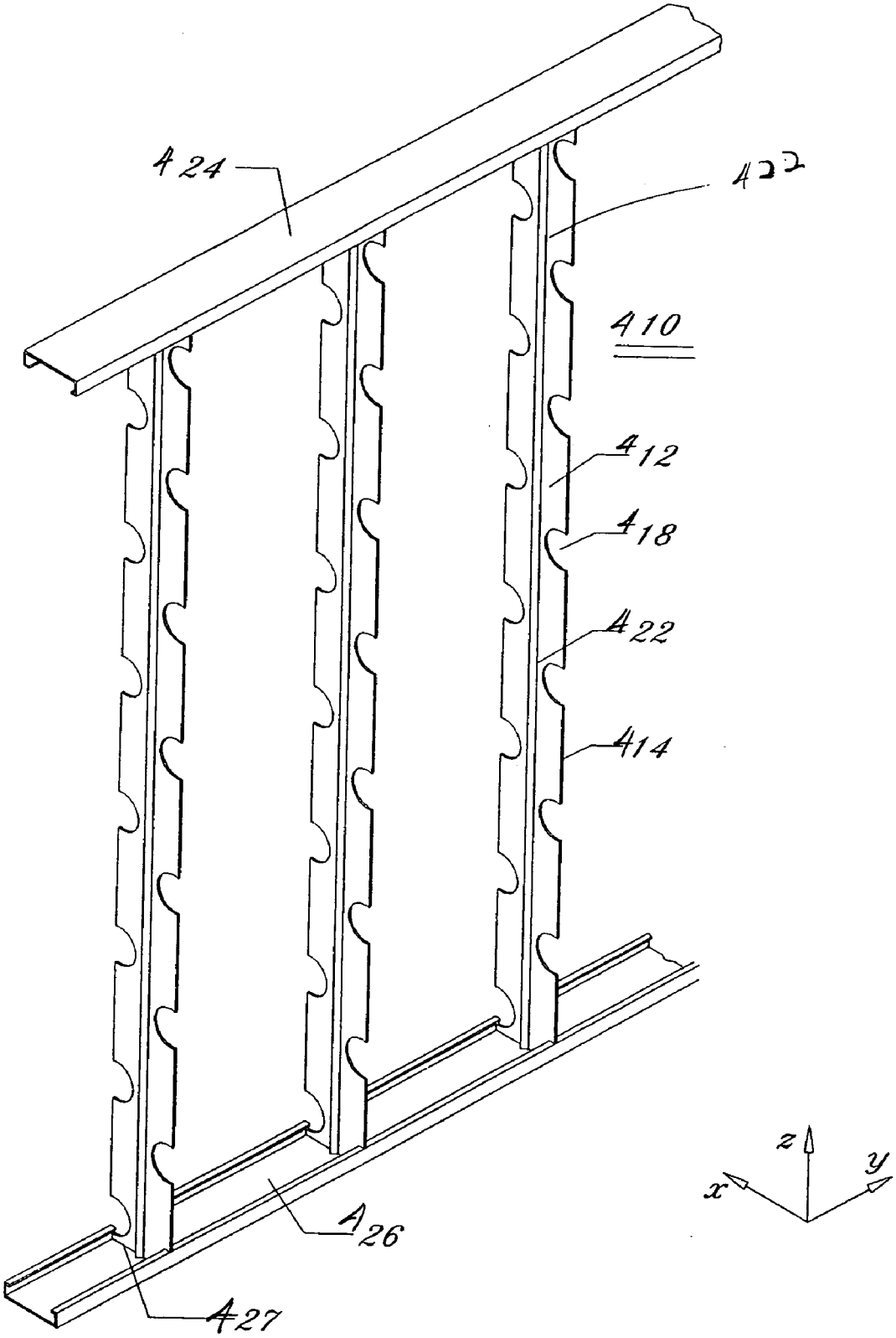
FIG. 11 is a perspective view of a fifth embodiment of the invention.

Shown in FIG. 11 is metallic stud 410 which is a yet further embodiment of the invention, generally related to the embodiment of FIGS. 7-8 described above, in which tabs 414 are separated from each other by interdigitating semi-circular spaces 418. As is the case in prior embodiments, metallic stud 410 is positioned between upper and lower U-shaped framing elements 424 and 426. Lines 427 of FIG. 11 represents a line of securement, typically by welding, between a z-axis end of stud 410 and inner surfaces of U-shaped elements 42 and 426.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the claims appended herewith.

The invention claimed is:

1. A framing structure, comprising:

(a) a plurality of metallic studs, each stud comprising:

(i) a z-axis elongate generally rectangular integral xz plane web having a width in a yz plane thereof;

(ii) a series of xz plane tabs each having a trapezoidal-like geometry including a major base thereof, said tabs projecting within both a positive and negative x-axis direction, said tabs interdigitating with void spaces, along at least one z-axis edge of said web; and (iii) within said integral xz plane web, a z-axis elongate apex element projecting in a yz plane and integrally dependent from said web of said stud; and (b) concrete panels cast about both positive and negative x-axis tabs associated with both z-axis edges of said web.

2. The framing structure as recited in claim 1, in which said z-axis apex element projects from an x-axis centerline of said web.

3. The framing structure as recited in claim 1, in which a relationship of a x-axis dimension of said web to a z-axis dimension of each major base of said tabs comprises a ratio in a range of about 1:1 to about 1:5.

4. The framing structure as recited in claim 1, in which said void spaces are complementally configured with said xz plane tabs.

* * * * *